United States Patent [19]

Schippers et al.

[11] 4,007,884

[45] Feb. 15, 1977

[54] WINDING APPARATUS

[75] Inventors: Heinz Schippers; Erich Lenk, both of Remscheid, Germany

[73] Assignee: Barmag Barmer Maschinenfabrik Aktiengesellschaft, Wuppertal, Germany

[22] Filed: June 25, 1975

[21] Appl. No.: 590,119

[30] Foreign Application Priority Data

July 1, 1974 Germany ..... 2431567

[52] U.S. Cl. ..... 242/41; 242/18 A; 242/18 DD; 242/81

[51] Int. Cl.[2] ..... B65H 67/04

[58] Field of Search ..... 242/18 A, 18 DD, 18 R, 242/35.5 A, 41, 81

[56] References Cited

UNITED STATES PATENTS

| | | | |
|---|---|---|---|
| 3,693,897 | 9/1972 | Davidson | 242/41 X |
| 3,762,661 | 10/1973 | Lucke | 242/41 X |
| 3,807,647 | 4/1974 | Miller | 242/41 X |
| 3,877,655 | 4/1975 | Cardinal et al. | 242/81 X |
| 3,908,918 | 9/1975 | Bergstrom | 242/41 X |
| 3,913,852 | 10/1975 | Lenk et al. | 242/18 A |
| 3,921,922 | 11/1975 | Wust | 242/18 A |

*Primary Examiner*—Stanley N. Gilreath
*Attorney, Agent, or Firm*—Johnston, Keil, Thompson & Shurtleff

[57] ABSTRACT

A thread winding machine or similar winding apparatus with a bobbin revolver carrying at least two chucks rotatable or pivotable between a winding position and an inoperative position, the machine including ejector means automatically dislodging a finished bobbin package from its chuck upon reaching said inoperative position, e.g. by means of a push member engaging the inboard end of a bobbin tube on which the package is wound, and take-up means maintained in close proximity below the finished package at the inoperative position to act as a package receiving cradle mounted slidably on the machine for movement axially outwardly of the chuck and to support the dislodged package in a rest position forward of the chucks, i.e. in front of the outboard end of the chucks, and free of interference from a new package being wound on the chuck in the operative winding position.

3 Claims, 3 Drawing Figures

WINDING APPARATUS

In winding machines comprising multi-chuck bobbin revolvers at each winding unit or station, the finished package situated on a chuck in the rest position and the bobbin tube or package situated in the rotating working position are liable to come into contact and damage one another, especially as the rotating package diameter increases. One factor which has to be taken into consideration in this respect is that the diameter of the bobbin in the working position increases very quickly at the beginning of the winding cycle. This phenomenon is particularly disturbing in cases where the winding unit with its bobbin revolver is required to be small and compact but is intended for winding threads, yarns, filaments, tapes, films or the like of relatively large thickness or high denier. In many instances, the finished bobbin package must be removed from the chuck situated in the rest position at just the right moment of time. Unless the finished package is withdrawn within a reasonably short period of time after it has reached the rest position on the bobbin revolver, it can even cause complete stoppage with severe damage to the rotating bobbin as well as the finished package. In the case of manual operation, this immediate withdrawal of finished bobbin packages requires considerable labor where the threads, tapes, films or the like accumulate continuously on fresh windings at high speed, so that the machine operator must be exceptionally alert to handle each bobbin change, and every removal of a finished package must be carried out by the operator without any delay in order to avoid serious damage. Even with semi-automatic retrieval devices used in this art, it is still difficult to monitor and service all winding units.

The object of the present invention is to equip each winding unit in such a manner that the finished package and the package in the process of being wound are fully prevented from coming into contact with one another. Moreover, this object is achieved automatically without any need for intervention by the machine attendant, thereby eliminating the otherwise absolute necessity of servicing each winding unit immediately after each bobbin change.

This object is achieved, in accordance with the invention, by providing an improved bobbin or package recovery means mounted on and in direct combination with a winding machine having at least two rotatable bobbin-holding chucks mounted in a cantilevered projecting manner on a rotatable or pivotal bobbin revolver adapted to shift each chuck and its associated bobbin tube or package from an upper operative chuck winding position to a lower inoperative chuck position. This improved recovery means essentially includes (a) ejector means for dislodging the finished package from the chuck in its lower inoperative position; and (b) take-up means for receiving the finished package after being dislodged from its inoperative chuck, this take-up means being arranged below the inoperative chuck in close proximity to the circumference of the finished package when on its chuck loacated in said lower inoperative position, and the take-up means also being axially extendable or slidable outwardly of the chucks to hold the finished package in a rest position in front of the outboard end of the chucks.

The take-up means comprises supporting members, preferably in the form of elongated rods, bars or the like, mounted on the winding machine to slide or extend along their own longitudinal axes which are parallel to each other and also to the winding axes of the chucks and their respective bobbins or winding packages. It is possible to use only two such support members to act as a receiving cradle or nesting means in order to hold the ejected or discharged bobbin package therein at almost the same height or level as the lower rest position of the inoperative chuck. Thus, when the support members are in very close proximity to the outer circumference of the bobbin package on the inoperative chuck, this package can be moved only a short distance and relatively gently onto the take-up means or receiving cradle when ejected from the chuck.

In one preferred embodiment, the axially extendable take-up means in the form of a supporting member or members is also radially adjustable towards the axis of the inoperative chuck, thereby permitting the take-up means to be adapted to any desired diameter of the finished package and positioning the take-up means as close as possible to the finished package during ejection. This prevents damage to sensitive materials, e.g. synthetic fibers or yarns, as they drop down from the chuck while at its lower inoperative position onto the take-up means.

Another solution to the problem of preventing damage to the finished package is provided by a preferred embodiment in which the ejector means and take-up means are moved synchronously by a single axial push member. The take-up unit can be returned to its starting position, preferably by hand, independently of the ejector means. The apparatus of the invention in a winding machine is described in detail hereinafter with reference to the accompanying drawings, in which.

Figure 1:
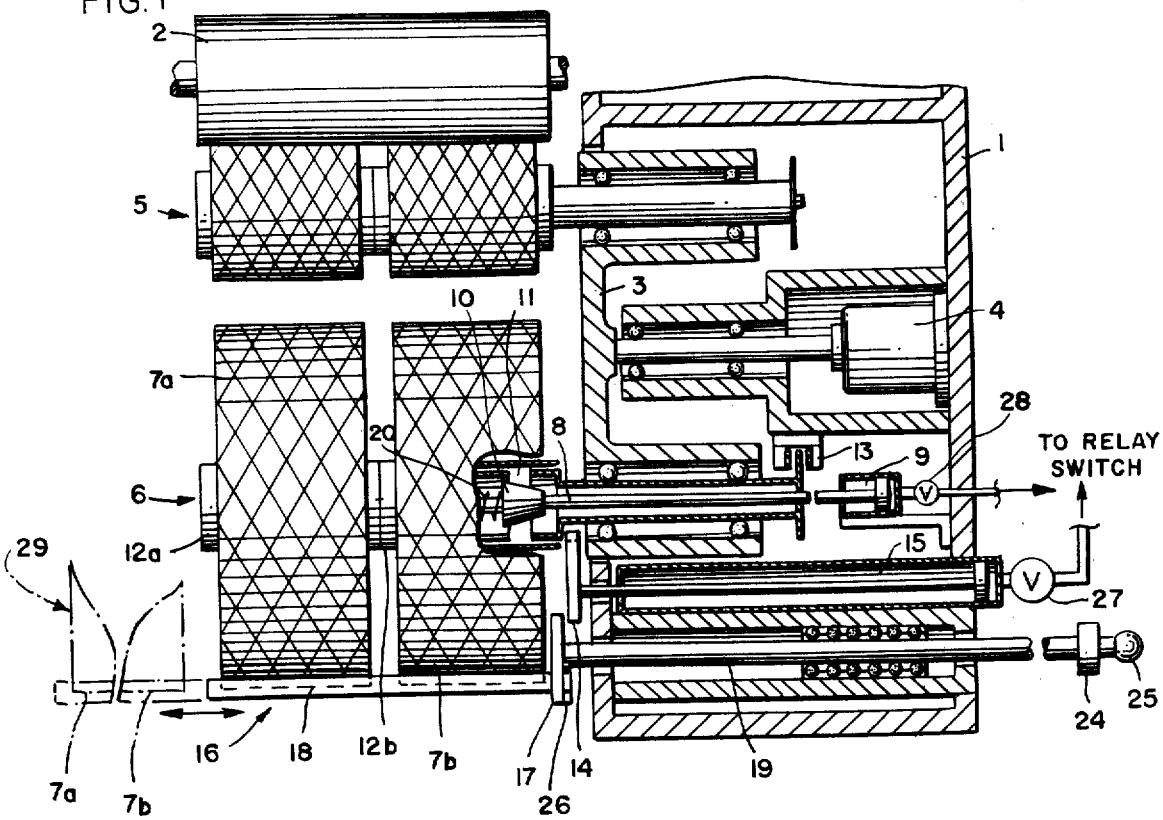
FIG. 1 is a partly schematic section through a thread winding unit carrying a take-up device or double rod cradle for receiving the finished bobbin package.

FIG.1 illustrates the most important parts of a winding machine 1 for the high-speed winding of threads composed of synthetic fibers or filaments. The individual winding unit is of the type commonly used in spinning or spin-drawing installations for synthetic filaments. Particulars of a winding unit of this kind may be found, for example, in German published patent (DT-OS) 2,364,284, which corresponds to U.S. application Ser. No. 534,648, filed Dec. 22, 1973. The winding unit consists basically of a contact roller 2 which is preferably a friction drive roller, a bobbin revolver 3, a revolver drive means such as motor 4, an operative chuck 5 being wound and an inoperative chuck 6 in the rest position. The two chucks 5 and 6 are mounted for free rotation on the bobbin revolver as shown by the schematic bearing mounts. A pushrod 8 and a piston-and-cylinder assembly 9 acts to relieve the inoperative chuck 6 of its clamping or holding pressure, the chuck comprising a plurality of bevel gears 10 and split rings 11 arranged axially one behind the other with a conical inner surface for securely holding the bobbin tube 12 under the pressure of a spring 20. A brake 13 may be used for braking the inoperative chuck to a standstill, and an ejector 14 is actuated by the piston-and-cylinder assembly 15.

Instead of the illustrated chuck, it is possible to use chucks of many different constructions, for example, one which is preferably made according to (DT-OS) 2,106,493, corresponding to U.S. Pat. No. 3,815,836, in which case the tube is released from the chuck by an attachment which turns or at least holds the chuck relative to the tube. This attachment can be a simple brake means such as 13 positively applied to clamp the inboard end of the chuck 6.

In addition, the winding unit is provided with a take-up means 16 comprising rods 18 which are mounted on plate 17 to form a receiving cradle axially slidable by means of the guide bars 19. As can also be seen from FIGS. 2 and 3, the take-up device 16 in both the illustrated embodiments, consists of two parallel cylindrical rods 18*a* and 18*b* which are arranged as close as possible to the periphery of the finished package 7. As shown in FIG. 1, two finished packages 7*a* and 7*b* are chuck-mounted on the tubes 12*a* and 12*b*, respectively. However, it is also important to ensure that when the bobbin revolver swings the finished package downwardly, e.g. the arc 21 as in FIG. 3, they must not come into contact with the bars 18*a* and 18*b* where the wound material is sensitive to abrasive damage. Even with smooth rounded surfaces of rods 18*a* and 18*b*, it is dangerous to permit contact between the package periphery and the rods until the bobbin has been braked to a standstill. The bars 18*a* and 18*b* are fixed to plate 17, e.g. by locking nuts 26, and plate 17 is mounted and directly carried on another two rods or bars 19*a* and 19*b*. These bars 19*a* and 19*b* are guided in the frame 1 of the winding machine by means of the schematically illustrated bearings to permit an axial sliding or extending movement freely on the frame.

The ejector 14 can be designed as a second lateral plate member in such a way that it engages the back end of tube 12*b* contained on the inoperative chuck 6 while simultaneously also engaging the plate 17. The upper end of the plate ejector 14 is notched so that it bypasses the chuck 6 at its inboard end as it directly engages and pushes against the bobbin tube 12*b*. The outer bobbin tube 12*a* is in turn pushed out by the inner tube 12*b*.

Thus, on actuation of the cylinder-and-piston assembly 15 through valve 27 by the relay switch 23 as operated by pin 22 (FIG. 3), which takes place simultaneously with the actuation of the piston-and-cylinder assembly 9 through valve 28 by the same switch 23 in order to release the chuck, the two tubes 12*a* and 12*b* mounted on the inoperative chuck 6 are ejected or dislodged from the chuck away from the front of the winding machine 1. The take-up device or cradle 16 for collecting the finished packages 12*a* and 12*b* is also moved outwardly as plate 14 contacts and pushes plate 17 to a forward rest position 29 indicated in phantom lines where the packages are deposited a short distance in front of the outboard end of the two chucks 5 and 6, thereby being completely clear of the rapidly growing bobbin on the operative chuck 5. The guide bars 19 are limited in their forward sliding travel by the stop collar 24 meeting frame 1 on the back side. Collar 24 is preferably threaded for axial adjustment on each bar 19 so as to permit different axial extensions of the take-off device or cradle 16. The ejector 14 may then be returned to its starting position, using a double-acting piston-cylinder 15 in which the compressed air passes from the valve 27 to the opposite chamber as soon as the ejection is completed or after a short delay, e.g. using a similar pin and switch arrangement on a second valve or by turning valve 27 to a second position with a time-delay circuit. Such control mechanisms are conventional in achieving an automatic reciprocal ejection movement. Reference is also made to British Patent (GB-PS) 870,402 for a suitable ejector of a somewhat different design but one which is readily adaptable to the present invention. The chuck 6 is only tightened again or made operative after new empty tubes 12*a* and 12*b* have been fitted on to it. The take-up device 16 for the finished packages 7*a* and 7*b* remains in its pushed-out position 29 only until the finished packages have been removed either by hand or by a doffer and carried away. The time available for this removal is up to one complete winding cycle, i.e., practically until the package on chuck 5 is completely wound. The take-up device 16 may be returned to its starting position either by hand, pulling from behind by knob 25, or pushing in front by the doffer (not shown). Winding units often are not easily accessible at the rear so that it is easiest to simply push the cradle or take-up means 16 by hand back into the machine frame 1 until the plate 17 again contacts or is closely adjacent to ejector plate 14.

Figure 2:
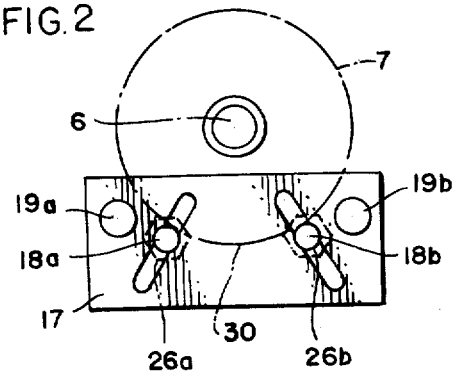
FIG. 2 is a front view of the take-up device adjustable to the required diameter of the finished package.

In the take-up device illustrated in FIG. 2, the rods 18*a* and 18*b* are vertically adjustable, i.e. substantially radially towards the center or axis of the inoperative chuck 6, using the locking nuts 26*a* and 26*b*. In this way, it is possible to adapt the take-up device to various different required diameters of the finished package 7. It is emphasized that the rods 18 must be maintained in a position quite close to the outermost circumference of the finished package without being in contact therewith, thereby permitting only a very short gap or distance of free fall of the finished packages 12 onto the rods 18.

Figure 3:
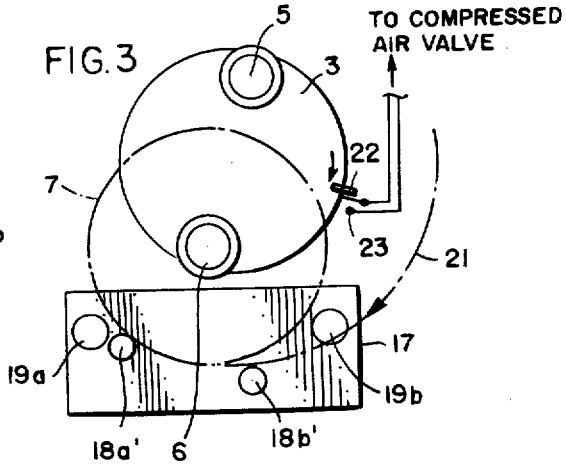
FIG. 3 is a front view of another preferred embodiment having an asymmetrical arrangement of the double rod cradle.

In FIG. 3, the take-up device also consists of the rods 18*a*′ and 18*b*′. However, these rods are arranged asymmetrically relative to the inoperative chuck 6, the bar 18*b*′ lying in front of the vertical axial plane of the chuck, looking in the direction of rotation 21 caused by bobbin revolver 3, in such a way that the finished package 7 does not come into contact with the rod 18*b*′ when the chuck is moved into its inoperative position. On the other hand, the finished package may be carefully moved so that its periphery just comes into contact with the bar 18*a*′. The advantage of this asymmetrically arranged cradle, formed by the rods 18*a*′ and 18*b*′, resides in the fact that, when dislodged from its chuck 6, the finished package 7 does not drop freely onto the take-up unit, but instead pivots on the rod 18*a*′, thus cushioning the fall into the cradle. Care must be exercised in this case to avoid abrasive rotating contact of the package 7 with rod 18*a*′.

One may also view this take-up means of FIG. 3 as comprising supporting members or means arranged asymmetrically relative to the inoperative chuck in the form of a receiving cradle inclined towards the rotating or pivoting movement of the bobbin revolver by which a chuck carrying the finished packsge is shifted into its lower inoperative position.

The take-up device may of course also be spring-mounted so as to resiliently force the cradle 16 formed by the rod supports 18 from their inboard position adjacent the winding machine 1 to their outboard position 29 free of the chucks 5 and 6. The take-off device or cradle 16 can be releasably locked in the inboard position with the spring compressed, e.g. by means of a spring-urged catchlock or the like which in turn may be operated by a solenoid arm actuated by switch 23. Again, the ejecting movement of the piston-cylinder assembly 15 is coordinated with the extending or sliding movement of the cradle 16 even without a direct mechanical connection or linkage.

The take-up device need not consist of individual rods but instead may be in the form of a shell-like or curved structure conformed to the required cylindrical periphery of the finished package 7. The take-up device or cradle may also be formed by a sling made of a fabric or other flexible material or even a number of elastic bands extending between the two rods 18*a* and 18*b* so as to follow closely the lower arc 30 of the package 7 between the rods as indicated in FIG. 2.

Other variations in structure and operation of the winding machine can be adopted while maintaining the essential features of an ejection means and cradle receiver as required by the improved combination of the invention.

We claim:

1. In a winding machine having at least two rotatable bobbin-holding chucks mounted in a cantilevered projecting manner on a rotatable or pivotal bobbin revolver adapted to shift each chuck and its associated bobbin tube or package in a rotating or pivoting movement from an upper operative chuck winding position to a lower inoperative chuck position, the improvement which comprises:

ejector means for dislodging the finished bobbin package from the chuck in its lower inoperative position; and take-up means for receiving said finished package after being dislodged from the chuck in its lower inoperative position, said take-up means being arranged below the chuck in its inoperative position in close proximity to the circumference of the finished package thereon and including supporting members arranged asymmetrically relative to the vertical axial plane of the chuck in its lower inoperative position to provide a receiving cradle inclined from the horizontal towards the rotating or pivoting movement of the bobbin revolver by which a chuck carrying the finished package is shifted into its lower inoperative position; and means to axially extend said take-up means outwardly of the chucks to hold the dislodged finished package in front of the outboard end of the chucks.

2. A winding machine as claimed in claim 1 wherein said supporting members providing the inclined receiving cradle comprise two rods extending axially parallel to the chuck, one rod being arranged in front of said vertical axial plane of the chuck in its lower inoperative position when viewed in the direction of said rotating or pivoting movement of the bobbin revolver, and the other rod being arranged behind said vertical axial plane as a pivot means for the dislodged finished package.

3. A winding machine as claimed in claim 1 including means to synchronously move said ejector means and said take-up means with one another.

* * * * *